US006481420B2

(12) United States Patent
Panasuk et al.

(10) Patent No.: US 6,481,420 B2
(45) Date of Patent: Nov. 19, 2002

(54) METHOD AND APPARATUS FOR MAINTAINING THE ALIGNMENT OF A FUEL INJECTOR

(75) Inventors: Gerard N. Panasuk, Hartland, MI (US); Jamey M. Chatlos, Charlotte, NC (US); Matthew M. Cole, Pulheim (DE); Paul P. Pucci, Ann Arbor; Raymond N. Maurer, Novi, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/773,201

(22) Filed: Jan. 30, 2001

(65) Prior Publication Data

US 2002/0100456 A1 Aug. 1, 2002

(51) Int. Cl.[7] ..... F02M 37/04
(52) U.S. Cl. ..... 123/470; 123/469
(58) Field of Search ..... 123/468, 469, 123/470, 456

(56) References Cited

U.S. PATENT DOCUMENTS

| | | | | | |
|---|---|---|---|---|---|
| 4,984,548 | A | * | 1/1991 | Hudson, Jr. | 123/470 |
| 4,993,390 | A | * | 2/1991 | Ono et al. | 123/470 |
| 5,136,999 | A | * | 8/1992 | Bassler et al. | 123/470 |
| 5,501,195 | A | * | 3/1996 | Hall | 123/470 |
| 5,520,151 | A | * | 5/1996 | Gras et al. | 123/470 |
| 6,019,089 | A | * | 2/2000 | Taylor et al. | 123/470 |
| 6,053,149 | A | * | 4/2000 | Lorraine | 123/470 |
| 6,276,339 | B1 | * | 8/2001 | Shebert, Jr. | 123/470 |

* cited by examiner

*Primary Examiner*—Thomas N. Moulis
(74) *Attorney, Agent, or Firm*—Brinks Hofer Gilson & Lione

(57) ABSTRACT

A method and an apparatus for maintaining the alignment of a fuel injector during shipping and normal use. In one embodiment of the invention, a clip for retaining a fuel injector to a fuel rail cup that has an annular flange is provided. The clip has a substantially flat base to at least partially surround an end of the fuel injector and a plurality of upstanding tangs to receive and substantially surround the annular flange. An alignment protrusion is also provided on the clip to interface with the annular flange to prevent axial rotation of the fuel injector relative to the fuel rail cup.

42 Claims, 5 Drawing Sheets

METHOD AND APPARATUS FOR MAINTAINING THE ALIGNMENT OF A FUEL INJECTOR

FIELD OF THE INVENTION

The invention relates generally to the field of fuel injectors. In particular, this invention relates to a method for maintaining the proper alignment of a fuel injector with a fuel intake port utilizing a retaining clip.

DESCRIPTION OF THE RELATED ART

In modern multi-valve engines utilizing fuel injectors to supply fuel to intake ports, it is important to maintain the proper alignment between the fuel injectors and the corresponding intake ports. In multi-valve engines, it is important to maintain rotational alignment and reduce axial movement of the fuel injector. If a fuel injector is not properly aligned with an intake port, wall wetting can result. Wall wetting occurs when the fuel spray plume from the fuel injector is off-center, and some of the spray contacts the walls of the intake port. This results in reduced performance of the engine and adversely affected emissions. During the shipping process, fuel injectors are subjected to forces that can cause them to rotate and in some cases, even become dislodged from the fuel rails. To combat this problem, retaining clips were used when shipping fuel delivery systems containing fuel injectors.

These retaining clips were utilized as dunnage devices. The clips were attached at the interface between the fuel rails and the fuel injectors to prevent the fuel injectors from coming loose from the fuel rail cups during shipping. Early clips consisted of stamped metal pieces that were loosely fitted around the neck of the fuel injector. The clips had a number of upstanding protrusions providing bias towards the fuel rail cup and applying pressure thereon, keeping the injector attached to the fuel rail cup during shipping.

While this method prevented the injector from becoming dislodged and prevented some shifting, these early clips did not significantly prevent rotational movement of the injector in relation to the fuel rail cup during shipping. The clips were eventually improved to include an anti-rotation feature consisting of a tang positioned to interfere with the rotation of the fuel injector. The upstanding protrusions made contact with the fuel rail cup, and the anti-rotation tang extended in a direction towards the fuel rail to align with a slot on the fuel rail cup. This retainer was loosely fit to the injector and the fuel rail cup, and allowed slight rotation of the components until the anti-rotation tang came in contact with the sides of the slot on the fuel rail cup. This interference prevented further rotation during shipping.

Another method to prevent movement during shipping consisted of providing upright tangs biased towards the fuel rail cup and contacting the fuel rail cup. This method applied pressure to the sides of the fuel rail cup and prevented rotational movement of the fuel injector in relation to the fuel rail cup. This design was not compatible with certain materials used for fuel rails, especially composites and aluminum.

Other methods for preventing shifting during shipping for fuel rail cups formed from composites or aluminum were utilized. One method consisted of a retaining clip with protrusions directed towards the fuel rail. The fuel rail cup was expanded onto the sides of the fuel rail itself and a slot was defined on the side of the fuel rail. These protrusions were longer than the tangs and other protrusions described previously. A spring extended from one of these protrusions to contact the slot on the fuel rail to prevent shifting. However, this method did not significantly prevent axial rotation of the injector in relation to the fuel rail cup and since pressure was applied directly to the side of the fuel rail, certain materials could not be used to construct the fuel rail.

The above methods prevent damage to the fuel rail cup and the fuel injector that would be caused by large shifts during shipping. They also prevent the fuel injector from separating from the fuel rail cup. However, the fuel injector can still shift enough to affect alignment, and thus affect emissions and performance of the engine. It is desirable to prevent all shifting of the fuel injector in relation to the fuel rail cup during shipping in order to maintain the correct orientation of the fuel spray plume into the fuel intake. A retention method that accomplishes this would maintain its function even after shipping and reduce the need for repairs to the fuel injection system by preventing the injectors from becoming misaligned during both shipping and regular use.

BRIEF SUMMARY OF THE INVENTION

The present invention provides a method and an apparatus for maintaining the alignment of a fuel injector during shipping and normal use. In one embodiment of the invention, a clip for retaining a fuel injector to a fuel rail cup that has an annular flange is provided. The clip has a base to at least partially surround an end of the fuel injector and a plurality of upstanding tangs to receive and substantially surround the annular flange. An alignment protrusion is also provided on the clip to interface with the annular flange to prevent axial rotation of the fuel injector relative to the fuel rail cup.

In another embodiment of the present invention, a retaining clip and fuel rail cup combination is provided comprising a fuel rail cup attached to a fuel rail and having an annular flange with at least one slot defined in it extending radially from the fuel rail cup. A retaining clip with a flat base, an open side and a plurality of tangs arranged to substantially surround and grip the annular flange is provided and at least one protrusion extends upwardly from the flat base of the clip to be received in the slot in the annular flange.

In yet another embodiment of the present invention, a method for maintaining the alignment of a fuel injector relative to a fuel rail cup having an annular flange is provided. The method comprises the steps of positioning inwardly biased tangs on a retaining clip to apply pressure to the sides of the annular flange and preventing the axial rotation of the fuel injector by utilizing an alignment protrusion to align with a slot in the annular flange and apply pressure to the sides of the annular flange.

DETAILED DESCRIPTION OF THE PREFERRED EMBODIMENTS OF THE INVENTION

Figure 3:
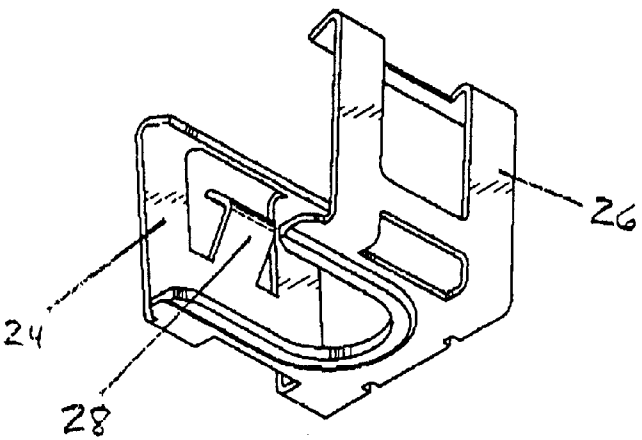
FIG. 3 PRIOR ART
FIG. 3 shows a prior art retaining clip.
Figure 2:
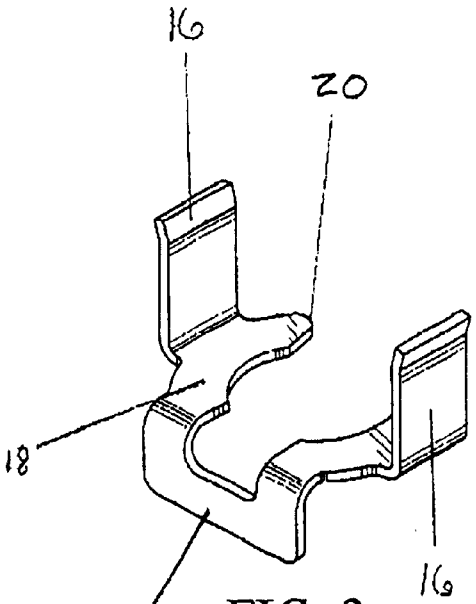
FIG. 2 PRIOR ART
FIG. 2 shows a prior art retaining clip.
Figure 1:
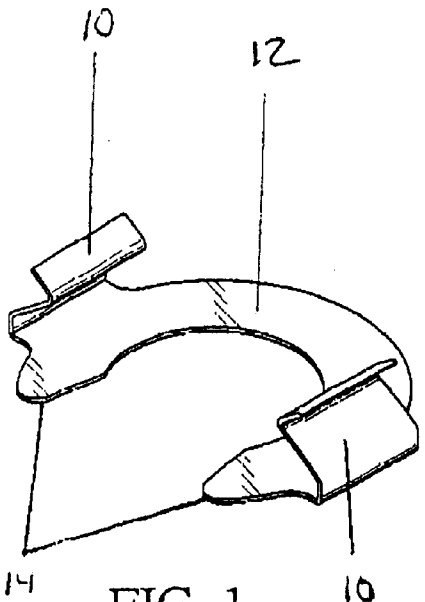
FIG. 1 PRIOR ART
FIG. 1 shows a prior art retaining clip.

Referring to the Figures, FIGS. 1–3 show a number of embodiments of prior art clips used as dunnage in engines utilizing fuel injectors. FIG. 1 shows a prior art clip with two protrusions 10 extending from a flat base 12. The flat base 12 has an open section at one end forming a pair of jaws 14. The jaws 14 slide into place in a groove on the fuel injector (not shown) and the protrusions 10 provide pressure against the sides of a fuel rail cup. This design kept the fuel injector from falling off of the fuel rail cup during shipping, but the fuel injector could still rotate around the circumference of the fuel rail cup. This design also was incompatible with certain materials used for construction of the fuel rail cup. The use of this design necessitated a redesign of the fuel rail cup.

FIG. 2 shows another prior art retaining clip used to prevent movement during shipping. This clip has two protrusions 16 extending from the flat base 18 of the clip and an opening in one side of the clip formed by a pair of jaws 20. Additionally, this clip has a protrusion 22 extending in the opposite direction than the other two protrusions 16. This third protrusion 22 acts to prevent some rotation of the fuel injector by interfering with rotation once the protrusion 22 comes into contact with any obstruction around the fuel injector.

This clip keeps the fuel injector from coming loose from the fuel rail cup during shipping and prevents some rotational movement of the injector.

FIG. 3 shows yet another prior art retaining clip utilizing two protrusions 24, 26. In this design, one protrusion 24 has a tang 28 biased toward the center that contacts the side of the fuel rail and creates a tighter hold. However, the fuel injector can still rotate slightly in relation to the fuel rail cup, and pressure is applied directly to the side of the fuel rail.

In FIGS. 4–7, a preferred embodiment of the retaining clip 30 of the present invention is shown. In this embodiment, the retaining clip 30 has a generally planar first side 32 and a second side 34 and preferably has an open side 36 on the first side 32. This open side 36 allows the retaining clip 30 to partially surround the fuel injector 38. An opening 40 is present in the center of the retaining clip 30. The retaining clip also has a flat base 42 of a thickness that allows it to slide into a groove 44 on the outer surface of the fuel injector 38. Two wide tangs 46 with a width wider than the two narrow tangs 48 are positioned at the end of the retaining clip 30 nearest the open side 36. The wide tangs 46 are preferably positioned on opposite sides of the flat base 42 and face toward the center of the opening 40 in the retaining clip 30. A set of narrow tangs 48 preferably extends from the flat base 42 of the retaining clip 30 near the second side 34 of the retaining clip 30.

The two sets of tangs 46, 48 preferably share a number of features. Each tang 46, 48 preferably comprises a bent metal flat spring that provides bias toward the center of the opening 40 of the retaining clip 30. The sloped surfaces 50 of the tangs 46, 48 allow for easy installation of the retaining clip 30 into the fuel rail cup 52. The tangs 46, 48 flex outward to allow the insertion of the fuel rail cup 52 and then snap back into their original position. Preferably, each tang 46, 48 has an indentation 54 near the flat base 42 of the retaining clip 30. This indentation 54 preferably corresponds to the thickness of the annular flange 56 on the fuel rail cup 52. When the retaining clip 30 is in position in the groove 44 on the fuel injector 38, the tangs 46, 48 are in a position to substantially surround and lock onto the annular flange 56 of the fuel rail cup 52 to secure the fuel injector 38 to the fuel rail cup 52. Since the retaining clip 30 is "active" under constant and permanent spring tension, once the tangs 46, 48 grip the annular flange 56 defined on the fuel rail cup 52, it takes a substantial force to separate the fuel injector 38 from the fuel rail cup 52. The varying widths of the tangs 46, 48 allow the tangs 46, 48 to apply equal pressure to all sides of the annular flange 56 defined on the fuel rail cup 52. This maintains rotational alignment at the interface between the retaining clip 30 and the fuel injector 38.

Figure 7:
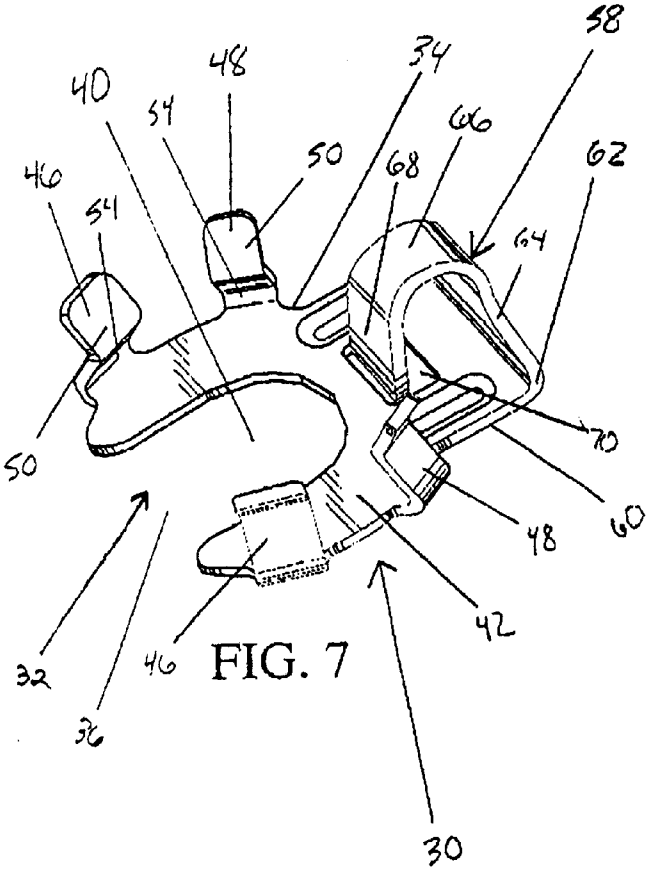
FIG. 7 shows a perspective view of an embodiment of the retaining clip of the invention.

In the embodiment of the invention shown in FIG. 7, an alignment protrusion 58 is located on the second side 34 of the retaining clip 30. The alignment protrusion 58 is formed from an extension 60 of the second side 34 of the retaining clip 30, allowing the entire retaining clip 30 to be formed from one continuous piece of material, preferably a stamped piece of metal. The alignment protrusion 58 extends from the end 62 of the extension 60 of the second side 34 of the retaining clip 30. It consists of a vertical section 64 that travels away from the flat base 42 of the retaining clip 30, a curved section 66 and a second vertical section 68 traveling toward the flat base 42. The second vertical section 68 passes through a rectangular opening 70 defined in the flat base 42. The alignment protrusion 58 is under spring tension and is biased toward the center of the opening 40 of the retaining clip 30.

Figure 8:
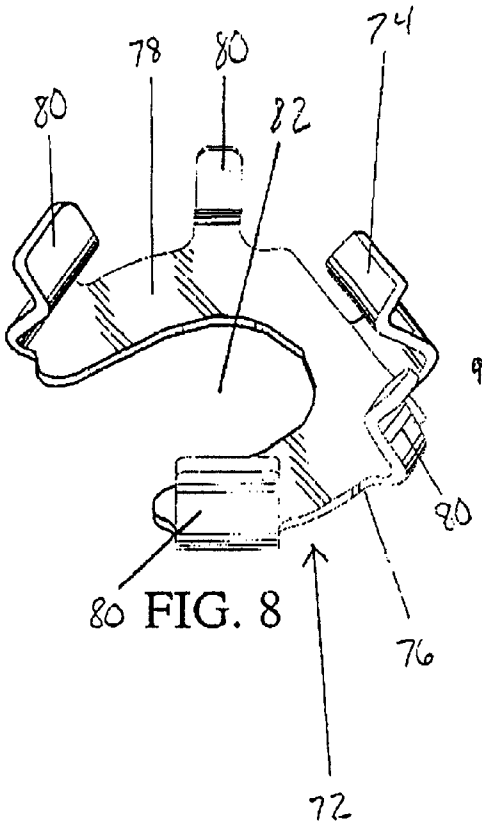
FIG. 8 shows a perspective view of another embodiment of the retaining clip of the invention.

FIG. 8 shows a second embodiment of the retaining clip 72 of the present invention. This embodiment shares the same features as the embodiment shown in FIG. 7 except for a variation in the design of the alignment protrusion 74. In this embodiment, the alignment protrusion 74 preferably extends from the underside 76 of the flat base 78 of the retaining clip 72. The shape of the alignment protrusion 74 is similar to the shape of the tangs 80 which extend from the flat base 78 of the retaining clip 72. The alignment protrusion 74 is under spring tension and provides bias toward the center of the opening 82 in the retaining clip 72. This embodiment has the advantage of simplified construction, as the rectangular opening 70 as shown in FIG. 7 does not need to be defined in the flat base 78 of the retaining clip 72.

Figure 9:
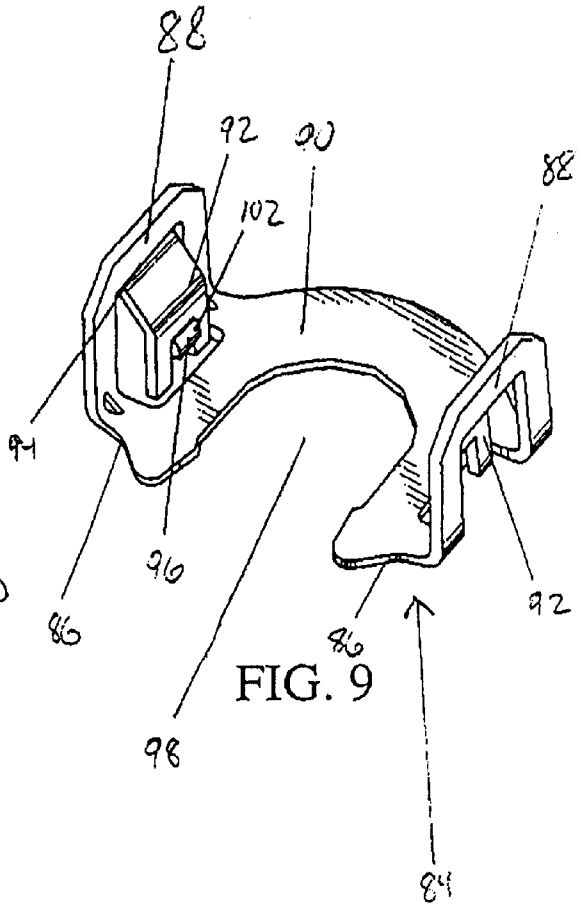
FIG. 9 shows a perspective view of another embodiment of the retaining clip of the invention.

A third embodiment of the retaining clip 84 of the present invention is shown in FIG. 9. In this embodiment, the outer edges 86 of the retaining clip 84 are extended to form protrusions 88 that are upstanding from the flat base 90 of the retaining clip 84. Each protrusion 88 has a tang 92 extending towards the flat base 90 of the retaining clip 84 beginning at the upper side 94 of the protrusion 88. Each tang 92 has a flange 96 that extends towards the center of the opening 98 in the retaining clip 84. The tangs 92 are under spring tension and may provide bias toward the center of the opening 98 in the retaining clip 84. The flanges 96 extending from the tangs 92 contact the upper edge 100 of the annular flange 56 on the fuel rail cup 52. These flanges 96 prevent the fuel injector 38 from pulling out of the fuel rail cup 52 once the retaining clip 84 is in place by snapping over the annular flange 56. Since bias may be applied in a direction toward the center of the opening 98 in the retaining clip 84, the tangs 96 must be decompressed in an outwardly direction in order to remove the fuel injector 38 from the fuel rail cup 52. This design maintains the proper alignment of the fuel injector as well as acting to prohibit movement of the fuel injector 38 during shipping by constantly and permanently applying spring tension. The sloped surface 102 of each flange 96 allows for easy installation of the fuel rail cup 52 into the retaining clip 84 once the retaining clip 84 is in place on the fuel injector 38.

Figure 4:
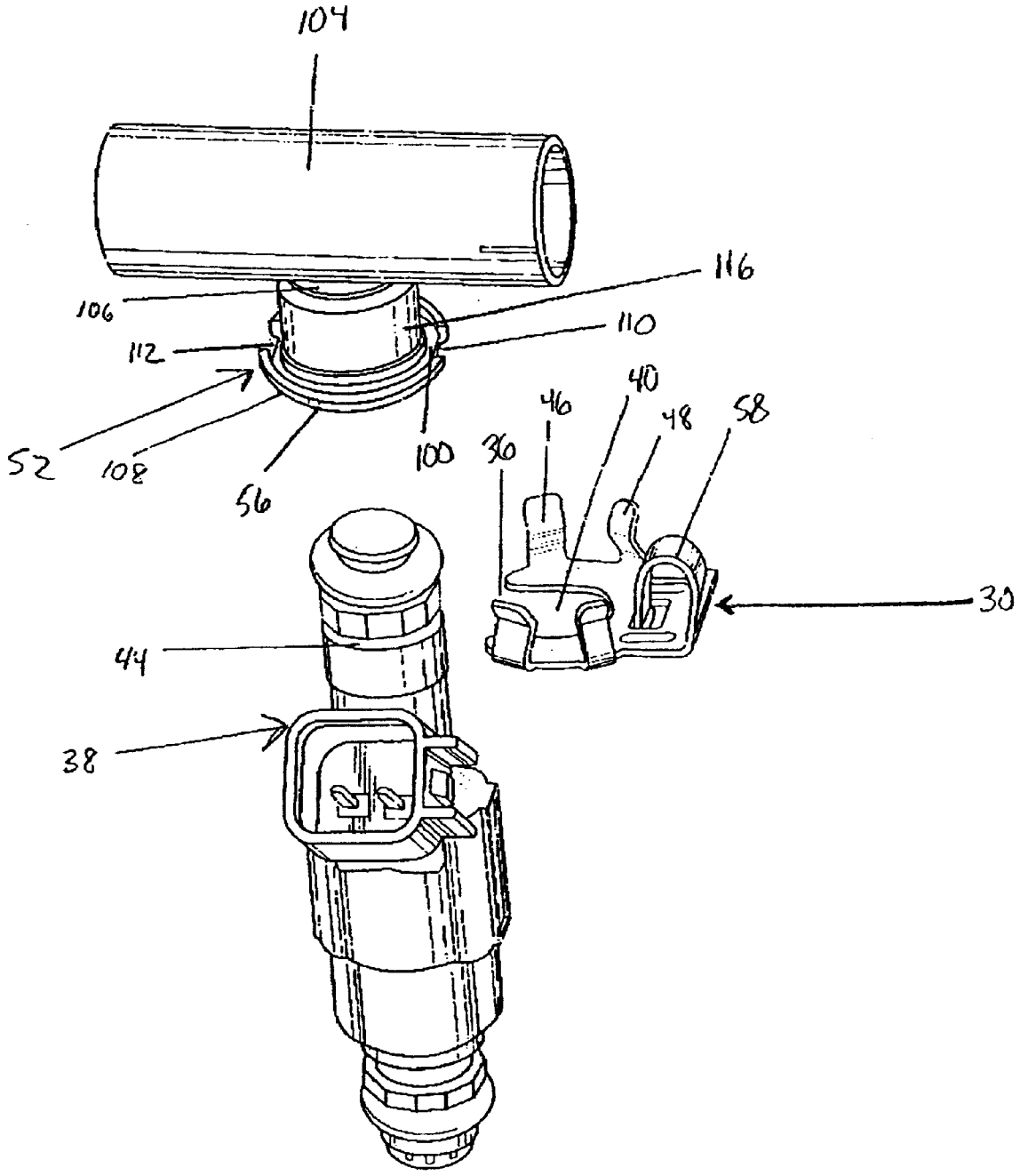
FIG. 4 shows an embodiment of the invention utilizing the embodiment of the retaining clip in FIG. 7 in its unassembled form.
Figure 5:
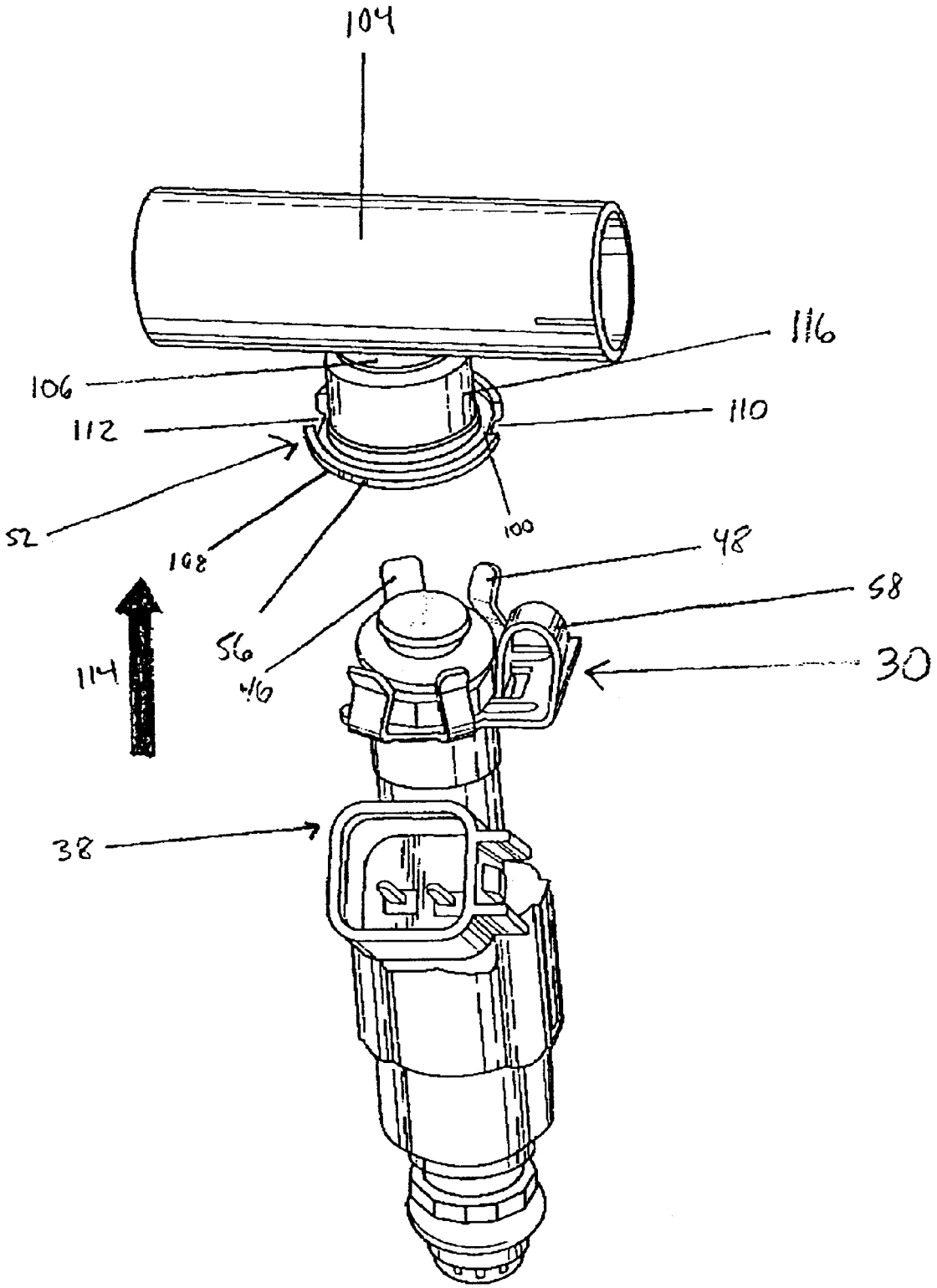
FIG. 5 shows an embodiment of the invention utilizing the embodiment of the retaining clip in FIG. 7 in its partly assembled form.
Figure 6:
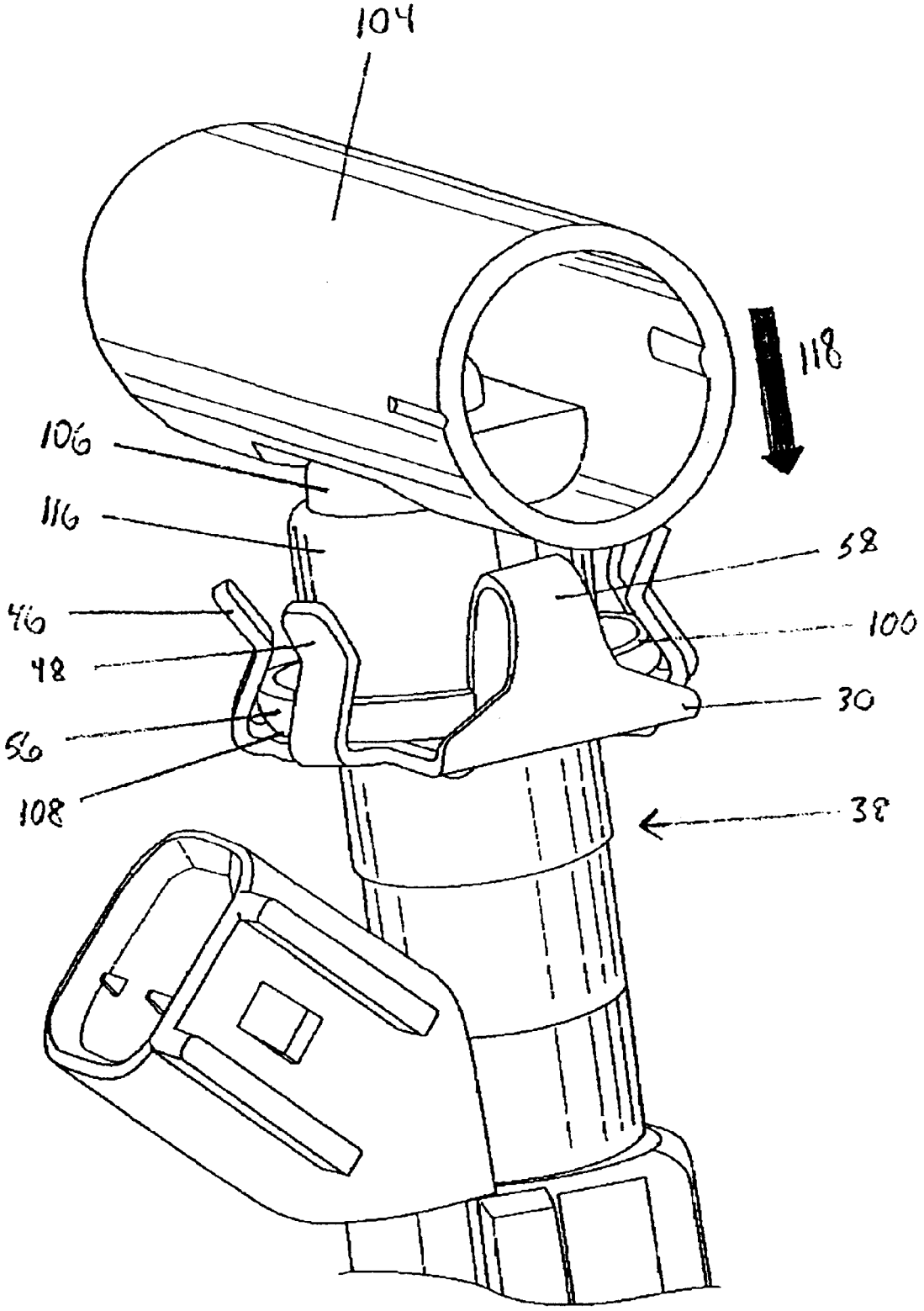
FIG. 6 shows an embodiment of the invention utilizing the embodiment of the retaining clip in FIG. 7 in its fully assembled form.

An embodiment of the present invention will be further described utilizing the retaining clip 30 shown in FIG. 7 and referring to FIGS. 4–6. FIG. 4 shows a view of an embodiment of the method in its unassembled form. A fuel rail 104 of generally conventional design has an attached fuel rail cup 52. The fuel rail cup 52 has a first end 106 and a second end 108. The first end 106 is attached to the fuel rail 104 and an opening (not shown) allows fuel to flow from the fuel rail 104 into the fuel rail cup 52. At the second end 108 of the fuel rail cup 52, an annular flange 56 extends radially from the outer surface of the fuel rail cup 52. The annular flange 56 preferably has at least one radial slot 110 defined within it. The number and location of the radial slots 110, 112 in the annular flange 56 can vary, and are dependant upon the embodiment of the retaining clip 30 utilized.

A standard fuel injector 38 of conventional design is shown in FIGS. 4–6. The fuel injector 38 preferably has at least one groove 44 defined on its exterior near the interface between the fuel injector 38 and the fuel rail cup 52. Preferably, this groove 44 circumvents a portion of the fuel injector 38, but does not circumvent the entire outer diameter of the fuel injector 38. Viewed from above, the groove 44 is preferably C-shaped. This shape prevents the retaining clip 30 from freely rotating around the fuel injector 38 once the retaining clip 30 is in place within the groove 44.

FIG. 5 shows the retaining clip 30 in place in the groove 44 on the fuel injector 38. In this position, the retaining clip 30 partially surrounds the fuel injector 38 and the C-shaped groove 44 prevents the retaining clip 30 from freely rotating around the fuel injector 38. Preferably, the retaining clip 30 and fuel rail cup 52 are aligned such that one of the two slots 110, 112 on the annular flange 56 aligns with the alignment protrusion 58 on the retaining clip 30. In FIG. 5, the fuel rail cup 52 is not yet in its final position. To complete the installation, the fuel injector 38 and retaining clip 30 slide onto the fuel rail cup 52 in a direction shown by an arrow 114 and the alignment protrusion 58 is received within a slot 110 defined on the annular flange 56.

FIG. 6 shows an embodiment of the invention in its fully assembled form. The retaining clip 30 is in place in the groove 44 defined on the fuel injector 38. The fuel rail cup 52 is aligned such that the alignment protrusion 58 of the retaining clip 30 is in place within a slot 110 defined on the annular flange 56 of the fuel rail cup 52. The wide tangs 46 and the narrow tangs 48 of the retaining clip 30 are in place over the annular flange 56 but do not come in contact with the main body 116 of the fuel rail cup 52. The tangs 46, 48 do not contact the fuel rail cup 52 at any location other than on the annular flange 56. The tangs 46, 48 are active under constant and permanent spring tension around the annular flange 56. The design and size of the wide 46 and narrow 48 tangs allow the tangs 46, 48 to distribute a generally equal and opposing holding force at areas around the circumference of the annular flange 56. This distributed force prevents the fuel injector 38 from becoming dislodged from the fuel rail cup 52 in an axial direction 118. The pressure supplied by the wide 46 and narrow 48 tangs also prevents the fuel injector 38 from rocking from side to side. In this position, the alignment protrusion 58 applies pressure to the annular flange 56 of the fuel rail cup 52 from its location in a slot 110 on the annular flange 56. The alignment protrusion is also active under constant and permanent spring tension, and this "active retention" force prevents substantially all rotation of the fuel injector 38 in relation to the fuel rail cup 52. The interaction between the slot 110 and the alignment protrusion 58 provide a self-centering mechanism and once the alignment protrusion 58 is in place within the slot 110, neither the retaining clip 30 nor the fuel injector 38 may rotate or shift in relation to the fuel injector cup 52. The alignment protrusion 58 interfaces with the sides of the slot 110 if rotation is attempted. Utilizing this method, the designer can orient the fuel injector 38 such that the injector spray plume remains in its proper position and does not cause wall wetting or other inefficiencies.

It should be noted that there could be a wide range of changes to the method without departing from its scope. As depicted in the Figures, there are many possible designs available for the retaining clip. Depending on the design of the retaining clip, the location of the slots 110, 112 on the annular flange 56 should be adjusted to correspond to the alignment protrusions on the retaining clip. For example, if the retaining clip 84 shown in FIG. 9 is used, there should be two slots defined on the annular flange 56 and they should be rotated 90 degrees from their position as shown in FIGS. 4–6. Other designs of the retaining clip that are not shown are also possible. Thus, it is intended that the foregoing detailed description be regarded as illustrative rather than limiting and that it be understood that it is the following claims, including all equivalents, which are intended to define the scope of the invention.

What is claimed is:

1. A clip for retaining a fuel injector to a fuel rail cup, said fuel rail cup having an annular flange, said clip comprising:

a base configured to at least partially surround an end of said fuel injector;

a plurality of tangs upstanding from said base, said tangs configured to receive and substantially surround said annular flange of said cup; and an alignment protrusion upstanding from said base, said protrusion interfacing with said flange to prevent axial rotation of said fuel injector relative to said fuel rail cup.

2. The clip of claim 1, wherein said flange further comprises a radial slot defined therein, and said protrusion is received within said slot.

3. The clip of claim 2, wherein said fuel injector further comprises a groove defined on its exterior surface, and said base of said clip is received within said groove.

4. The clip of claim 3, wherein said groove circumvents at least a portion of said fuel injector.

5. The clip of claim 4, wherein said tangs are biased toward said annular flange.

6. The clip of claim 5, wherein said tangs and said protrusion are under constant spring tension.

7. A retaining clip and fuel rail cup combination, said combination comprising:

a fuel rail cup attached to a fuel rail;

an annular flange extending radially from said fuel rail cup and having at least one slot defined on said annular flange;

a retaining clip having a flat base, an open side and a plurality of tangs upstanding from said base, said tangs arranged to substantially surround and grip said flange; and at least one protrusion extending upwardly from said flat base of said retaining clip and adapted to be received within said at least one slot defined on said annular flange.

8. The combination of claim 7, wherein said tangs and said protrusion are under constant spring tension.

9. The combination of claim 8, further comprising at least two narrow tangs and two wide tangs having a width wider than the width of said narrow tangs.

10. The combination of claim 9, wherein said two narrow tangs extend from said base of said retaining clip near said protrusion and are on opposite sides of said protrusion.

11. The combination of claim 10, wherein said two wide tangs extend from said base of said retaining clip near said open side and one wide tang extends from each side of said open side.

12. The combination of claim 11, wherein said tangs lock into place over said annular flange and do not contact said fuel rail cup at any other surface.

13. The combination of claim 7, wherein two slots are defined in said annular flange.

14. The combination of claim 13, wherein there are two protrusions and one of said protrusions extends upwardly from said flat base on each side of said open side.

15. A combination according to claim 14, wherein said two upwardly extending protrusions each have a tang extending inwardly from said upwardly extending protrusions.

16. A combination according to claim 15, wherein said inwardly extending tangs apply pressure to said annular flange.

17. A method for maintaining the alignment of a fuel injector relative to a fuel rail cup having an annular flange, said method comprising the steps of:

positioning inwardly biased tangs a retaining clip to apply pressure to the sides of said annular flange on said fuel rail cup; and preventing axial rotation of said fuel injector in relation to said fuel rail cup by utilizing at least one alignment protrusion to apply pressure to the sides of said annular flange and interface with at least one slot defined in said annular flange.

18. The method of claim 17, wherein two slots are defined in said annular flange on said fuel rail cup.

19. The method of claim 18, wherein said retaining clip has two upwardly extending protrusions extending from said base.

20. The method of claim 19, wherein said two protrusions are receivable within said two slots defined in said annular flange.

21. The method of claim 20, wherein said two upwardly extending protrusions each have a tang extending inwardly from said upwardly extending protrusions.

22. The method of claim 21, wherein said tangs apply pressure against said annular flange.

23. The method of claim 22, wherein said tangs are under constant spring tension.

24. The method of claim 17, wherein one slot is defined in said annular flange.

25. The method of claim 24, wherein a plurality of tangs extend upwardly from said base of said retaining clip.

26. The method of claim 25, further comprising two narrow tangs and two wide tangs.

27. The method of claim 26, wherein said two narrow tangs are located on said base of said retaining clip near said protrusion and on opposite sides of said protrusion.

28. The method of claim 27, wherein said protrusion interfaces with said slot defined in said annular flange.

29. A method for maintaining the alignment of a fuel injector relative to a fuel rail cup having an annular flange, said method comprising the steps of:

defining two slots in said annular flange;

positioning inwardly biased tangs on a retaining clip to apply pressure to the sides of said annular flange on said fuel rail cup;

positioning two alignment protrusions on said retaining clip, each of said upwardly extending protrusions having a tang extending inwardly;

positioning said two alignment protrusions within said two slots defined in said annular flange; and preventing axial rotation of said fuel injector in relation to said fuel rail cup by utilizing said two alignment protrusions to apply pressure to the sides of said annular flange and interface with at least one slot defined in said annular flange.

30. The method of claim 29, wherein said tangs apply pressure against said annular flange.

31. The method of claim 30, wherein said tangs are under constant spring tension.

32. The method of claim 29, wherein a plurality of tangs extend upwardly from said base of said retaining clip.

33. The method of claim 32, further comprising two narrow tangs and two wide tangs.

34. The method of claim 33, wherein said two narrow tangs are located on said base of said retaining clip near said protrusion and on opposite sides of said protrusion.

35. The method of claim 34, wherein said protrusion interfaces with said slot defined in said annular flange.

36. A method for maintaining the alignment of a fuel injector relative to a fuel rail cup having an annular flange, said method comprising the steps of:

defining a plurality of slots in said annular flange;

positioning inwardly biased tangs on a retaining clip to apply pressure towards said annular flange on said fuel rail cup;

positioning a plurality of alignment protrusions on said retaining clip, each of said upwardly extending protrusions comprising a tang extending inwardly; and positioning each of said plurality of alignment protrusions at least partially within each of said plurality of slots defined in said annular flange to prevent axial rotation of said fuel injector in relation to said fuel rail cup.

37. The method of claim 36, wherein said tangs contact said annular flange.

38. The method of claim 37, wherein said tangs are under constant spring tension.

39. The method of claim 36, wherein at least four tangs extend upwardly from said base of said retaining clip.

40. The method of claim 39, further comprising two narrow tangs and two wide tangs.

41. The method of claim 40, wherein said two narrow tangs are located on said base of said retaining clip near said protrusion and on opposite sides of said protrusion.

42. The method of claim 41, wherein said protrusion interfaces with said slot defined in said annular flange.

* * * * *